United States Patent [19]

Segler

[11] Patent Number: 4,554,689

[45] Date of Patent: Nov. 26, 1985

[54] STRENGTH SAVER COMMODE

[76] Inventor: Calvin A. Segler, 4110 Loma Alta Rd., Corpus Christi, Tex. 78410

[21] Appl. No.: 699,943

[22] Filed: Feb. 8, 1985

[51] Int. Cl.[4] ..... E03D 11/00

[52] U.S. Cl. ..... 4/254

[58] Field of Search ..... 4/252 R, 661, 254

[56] References Cited

U.S. PATENT DOCUMENTS

| | | | |
|---|---|---|---|
| D. 179,394 | 12/1956 | Mills | 4/254 |
| 775,029 | 11/1904 | Dezendorf | 4/254 |
| 2,023,901 | 12/1935 | Rhodes | 4/254 |
| 2,159,021 | 5/1939 | Groeniger | 4/252 R |
| 4,205,404 | 6/1980 | Levins | 4/661 |

FOREIGN PATENT DOCUMENTS

| | | | |
|---|---|---|---|
| 839936 | 4/1939 | France | 4/254 |
| 842422 | 6/1939 | France | 4/254 |
| 571895 | 1/1958 | Italy | 4/254 |
| 501354 | 2/1939 | United Kingdom | 4/254 |

*Primary Examiner*—Stephen Marcus
*Assistant Examiner*—Leo J. Peters

[57] ABSTRACT

This invention is a solid block placed between a commode and a floor to raise the commode seat; and including mounting bolts for the block and commode.

1 Claim, 5 Drawing Figures

FIG. 1
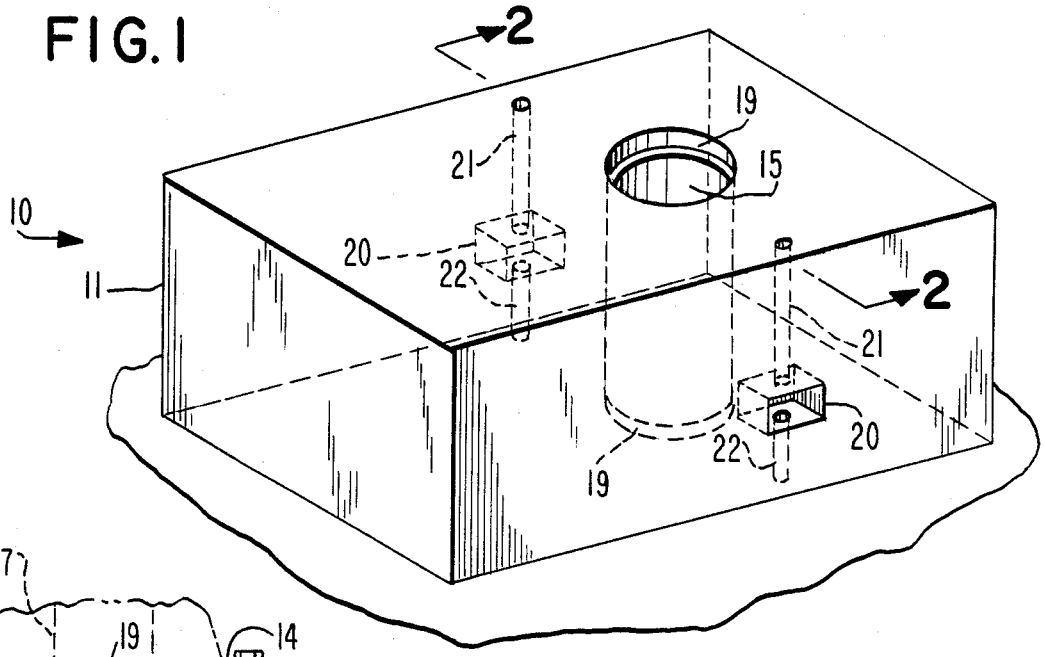
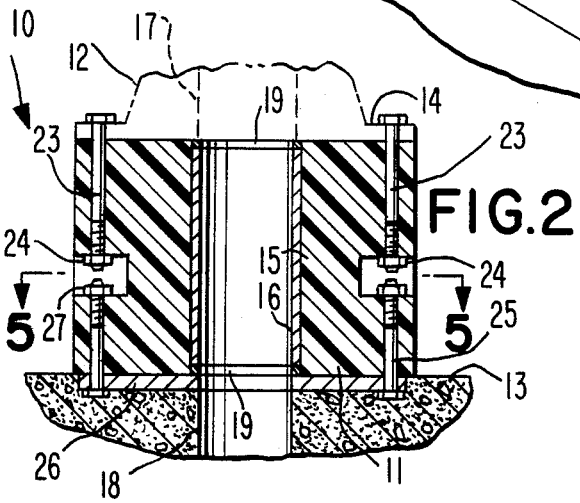
FIG. 2
FIG. 3
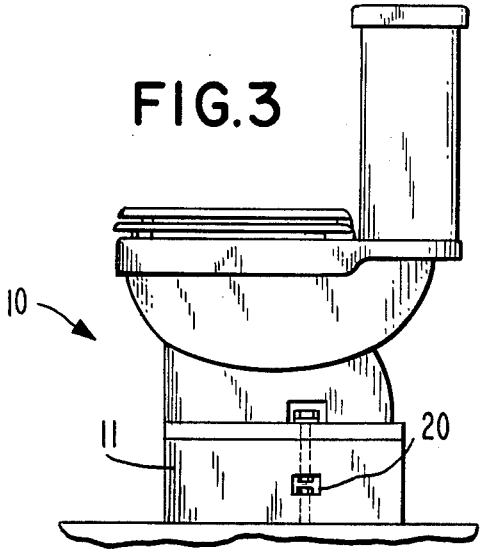
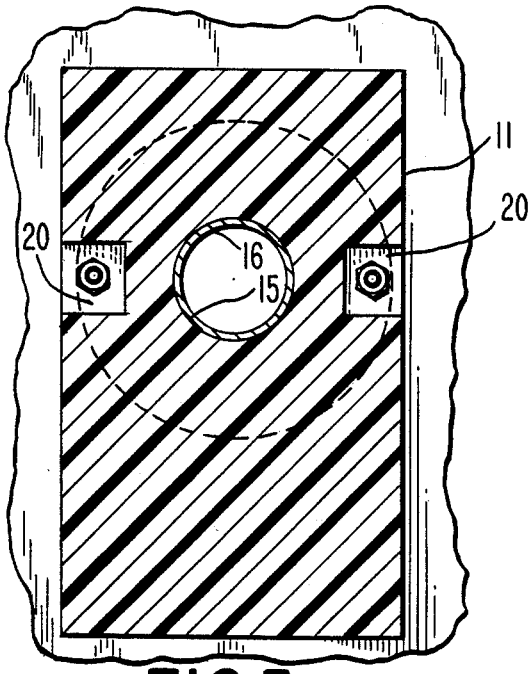
FIG. 5
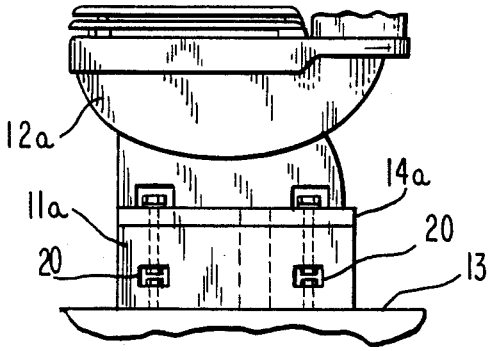
FIG. 4

STRENGTH SAVER COMMODE

This invention relates generally to commodes. More specifically it relates to a block upon which a commode is mounted.

It is well known that conventional commodes have a seat which is much lower than a seat of a conventional chair. The reason for this is so that a person seated on the commode and resting his feet on a floor can be in a more doubled up position for a more convenient evacuation. However, the low seat of such a commode presents problems to other persons who have physical disabilities, so that they cannot sit themselves down so low, nor are they able to lift themselves up afterwards, from such a low seat. This situation is, accordingly, in need of an improvement.

Therefore, it is a principal object of the present invention, to provide a strength saver commode, wherein the commode seat is at a raised height, so that physically debilitated persons find it easier to sit down and lift themselves up afterwards.

Another object is to provide a strength saver commode, which would be ideal for elderly persons, arthritics, or those having bad hip joints.

Other objects are to provide a strength saver commode, which is simple in design, inexpensive to manufacture, rugged in construction, easy to use, and efficient in operation.

These, and other objects, will be readily evident, upon a study of the following specification, and the accompanying drawing, wherein:

FIG. 1 is a prspective view of a block used to raise a typical commode shown in accordance with the present invention;

FIG. 2 is a cross-section view taken along 2—2 of FIG. 1 (broken away commode shown in dot-dash line);

FIG. 3 is a side elevation view of the embodiment being used with a typical commode;

FIG. 4 is a side elevation view of a second embodiment of the invention, and FIG. 5 is a cross-section view taken along line 5—5 of FIG. 2.

Referring now to the drawing in greater detail, and more particularly to FIGS. 1, 2, 3 and 5 thereof, at this time, the reference numeral 10 represents a strength saver commode according to the present invention, wherein there is a solid block 11 placed between a commode 12 and a floor 13.

The block may be molded either from concrete or else a hard plastic material. The size of the block is such so that its length and width fits precisely the contoured edge of a flange 14 formed around a base of the commode. The height of the block is suggested to be six inches for most practical situations although it may be manufactured in various different thicknesses so as to suit all special individuals.

The block is molded with a vertical central opening 15 therethrough in which a four inch diameter pipe 16 is fitted for connection between the commode drain outlet 17 and a drain pipe 18 in the floor of the house. A grease seal ring 19 is fitted against the upper and lower ends of the pipe for making the connection water-tight.

On each opposite side wall of the block a recess 20 is made approximately midway between the bottom and top of the block, and a pair of aligned, vertical openings 21 and 22 made in the block, connect with the recess. The upper opening 21 receives a bolt 23 that secures the commode upon the block, the bolt head resting against a top surface of the flange 14 and a threaded end of the bolt extending into the recess where a nut 24 can then be tightened inside the recess. A bolt 25 in the lower opening 22 is first inserted upwardly through a plate 26 mounted in the floor; the bolt head bearing against the underside of the plate while the bolt threaded end extends into the recess where a nut 27 is then tightened thereupon, thus securing the block stationarily upon the floor.

Reference is now made to FIG. 4 wherein a modified model of the block 11*a* is shown for use with a commode 12*a* having four mounting holes through its flange 14*a*, so that twice the number of mounting bolts and nuts are used in this model.

In use, a physically handicapped person thus more easily sits and rises from this strength saver commode.

While various changes may be made in the detail construction, it is understood that such changes will be within the spirit and scope of the present invention, as is defined by the appended claims.

I claim:

1. A strength saver commode, comprising, in combination, a block and a conventional commode for being mounted upon said block, and means for securement thereof together and for securement of said block upon the floor of a house; said block having a length and width contoured to fit an edge of a flange around a base of said commode, and a vertical opening through said block having a drain pipe therethrough for said commode; and said securement means comprising a recess on each opposite side of said block, each said recess being approximately midway between the top and bottom of said block, a pair of aligned vertical openings communicating through each said recess, an upper of said openings extending to said block top while a lower of said openings extends to said block bottom, a bolt in each said opening, said bolt in said upper opening having a head bearing against the top surface of said flange, a plate mounted in said floor, said bolt is said lower opening extending also through said plate and having its head bearing against an underside of said plate, and a threaded opposite end of each said bolt terminating within said recess and being fitted with a threaded nut.

* * * * *